United States Patent [19]

Hemmann

[11] Patent Number: 4,811,954

[45] Date of Patent: Mar. 14, 1989

[54] FOLDING CASE AND GAME BOARD ASSEMBLY

[75] Inventor: Ronald S. Hemmann, Newington, Conn.

[73] Assignee: Coleco Industries, Inc., West Hartford, Conn.

[21] Appl. No.: 142,808

[22] Filed: Jan. 6, 1988

[51] Int. Cl.[4] ..... A63F 3/00

[52] U.S. Cl. ..... 273/283; 206/315.1; 273/284; 273/309

[58] Field of Search ..... 273/283, 284, 285, 287, 273/309; 206/315.1

[56] References Cited

U.S. PATENT DOCUMENTS

| | | | |
|---|---|---|---|
| 174,958 | 3/1876 | Homrighausen . | |
| 2,282,128 | 5/1942 | Gubbins . | |
| 2,774,598 | 12/1956 | Strocco . | |
| 3,130,973 | 4/1964 | Zapolski . | |
| 4,101,131 | 7/1978 | Barnby | 273/287 X |
| 4,130,284 | 12/1978 | Fuks | 273/285 X |
| 4,275,887 | 6/1981 | Tateyama | 273/285 X |
| 4,277,067 | 7/1981 | Gettleman | 273/285 X |
| 4,371,168 | 2/1983 | Dupuis | 273/285 X |
| 4,513,974 | 4/1985 | Lin | 273/287 X |
| 4,613,040 | 9/1986 | Morris, II et al. | 206/315.1 |

*Primary Examiner*—Anton O. Oechsle

[57] ABSTRACT

A portable game board assembly is comprised of a pair of elongated tray elements which are hinged along one elongate side and open along that side between the hinge elements. The tray elements may be pivoted into a closed position to define a container. Stored in each one of the tray elements is a game board element which may be removed therefrom and rotated 90 degrees so as to extend across the hinged margin of the tray elements and secured in that position to rigidify the tray elements and provide a stable assembly. The playing board surface is provided by a paper or other printed web disposed below the transparent bottom wall of the game board elements and visible therethrough. The tray elements may be formed so as to provide compartments along the margins thereof for storage of game pieces and desirably include latch elements on the side opposite the hinges to close the two tray elements in assembly.

12 Claims, 2 Drawing Sheets

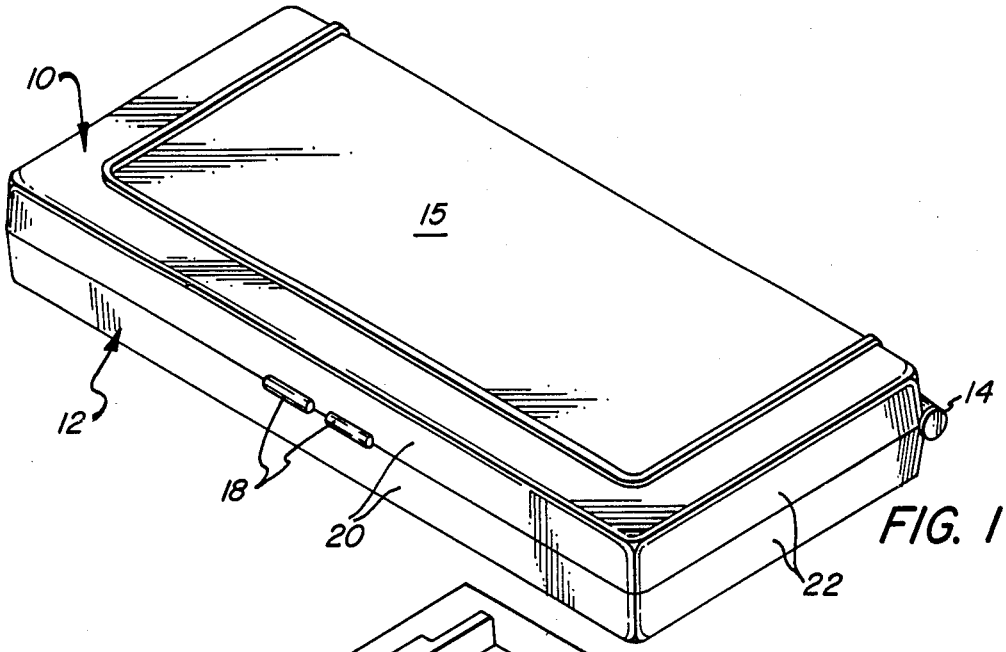
FIG. 1
FIG. 2
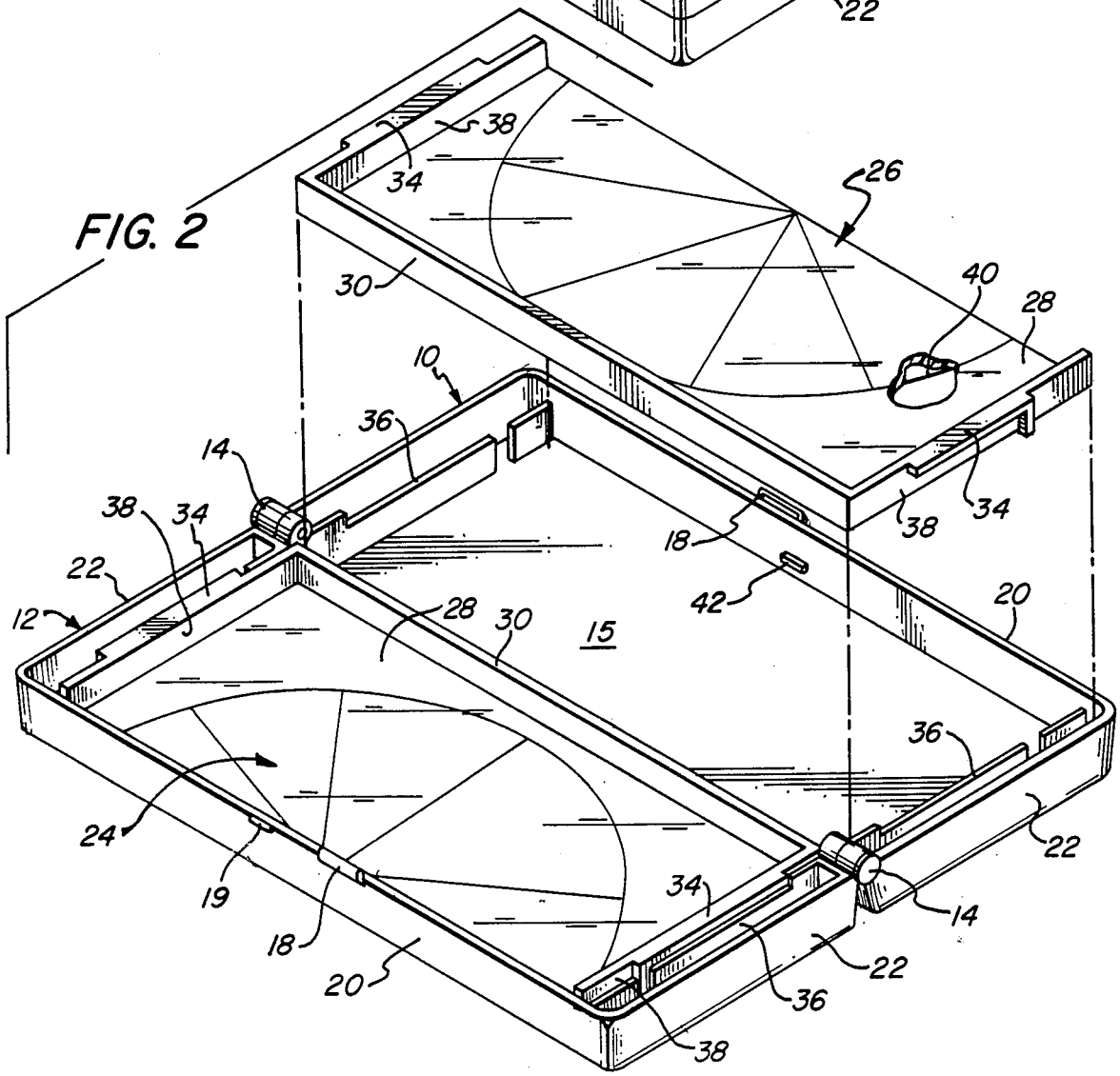

FOLDING CASE AND GAME BOARD ASSEMBLY

BACKGROUND OF THE INVENTION

The invention relates to portable game boards and more particularly to a portable game board container which may be readily rigidified for play action.

Frequently, it is desirable to have a game board assembly which can be readily transported and which includes a case for carrying the playing pieces required for the game board activity. Oftentimes, it is also desirable to have such a game board assembly in which the nature of the game being played may be varied through provision of several alternate game board designs or surfaces.

A number of game board containers have been proposed which include compartments for the playing pieces. Some game board assemblies have included multiple sheets defining different playing board surfaces and these are supported on the playing board container or elements thereof.

Dupuis U.S. Pat. No. 4,371,168 has proposed a playing board assembly which includes two case halves which are connected by a spine panel and the halves contain checker board elements which are slidable in channels to abut over the spine and to hold the halves in a rigid horizontal plane.

It is an object of the present invention to provide a novel portable game board assembly wherein there is included a folding case and playing board elements are utilized to rigidify the two halves of the carrying case to provide a convenient playing board.

It is also an object to provide such a portable game board assembly in which the components may be economically fabricated and readily assembled.

Another object is to provide such a portable game board assembly in which the nature of the playing board surface may be readily varied by the use of transparent playing board elements and imprinted elements disposed therebelow.

SUMMARY OF THE INVENTION

It has now been found that the foregoing and related objects and advantages can be readily attained in a portable game assembly which includes a foldable container comprised of a pair of tray elements with hinge means along one side margin of the tray elements and joining said tray elements for movement from a closed, overlying position to an open position in which the tray elements lie in a common plane. Latch means is also provided for securing the tray elements in the closed position, and the tray elements provided recesses therewithin. A pair of elongated game board elements is removably seated within respective recesses of the tray elements, and these elements are removable from the recesses of the trays in their open position. The game board elements are then movable into a second position in which they bridge the hinge line defined by the one side margin of the tray elements and they seat in the recesses of both trays to rigidify the container in said open position.

Preferably, the tray elements have a side wall opposite the one side margin and end walls, and the hinge means is disposed adjacent the junction of the end walls with the one side margin so that the tray elements are substantially open along the one side margin between the hinge means. Each of the game board elements has an upstanding side wall extending along the one side margin of their respective tray elements to effect substantial closure of the opening between the hinge means in the tray element in which seated when the case is in the closed position. Desirably, the game board elements also have upstanding end walls to provide side walls along three sides thereof, and the game board elements are disposed with their open side margins abutting each other in the second position thereof.

In the usual form, the latch means is provided along the side margin of the tray elements opposite the one side margin. Moreover, the tray elements and the game board elements interfit in the storage position of the game board elements. The game board elements also snugly seat within the tray elements in the second position thereof.

Desirably, the game board elements are substantially transparent and the assembly includes sheet-like playing surface defining elements below the game board elements in their second position, and these playing surface elements are visible through the game board elements to define the game board design.

BRIEF DESCRIPTION OF THE DRAWINGS

FIG. 1 is a perspective view of a portable playing board assembly embodying the present invention with the case halves in close position;

FIG. 2 is a partially exploded view thereof with the case halves in the open position;

DETAILED DESCRIPTION OF THE ILLUSTRATED EMBODIMENT

Figure 3:
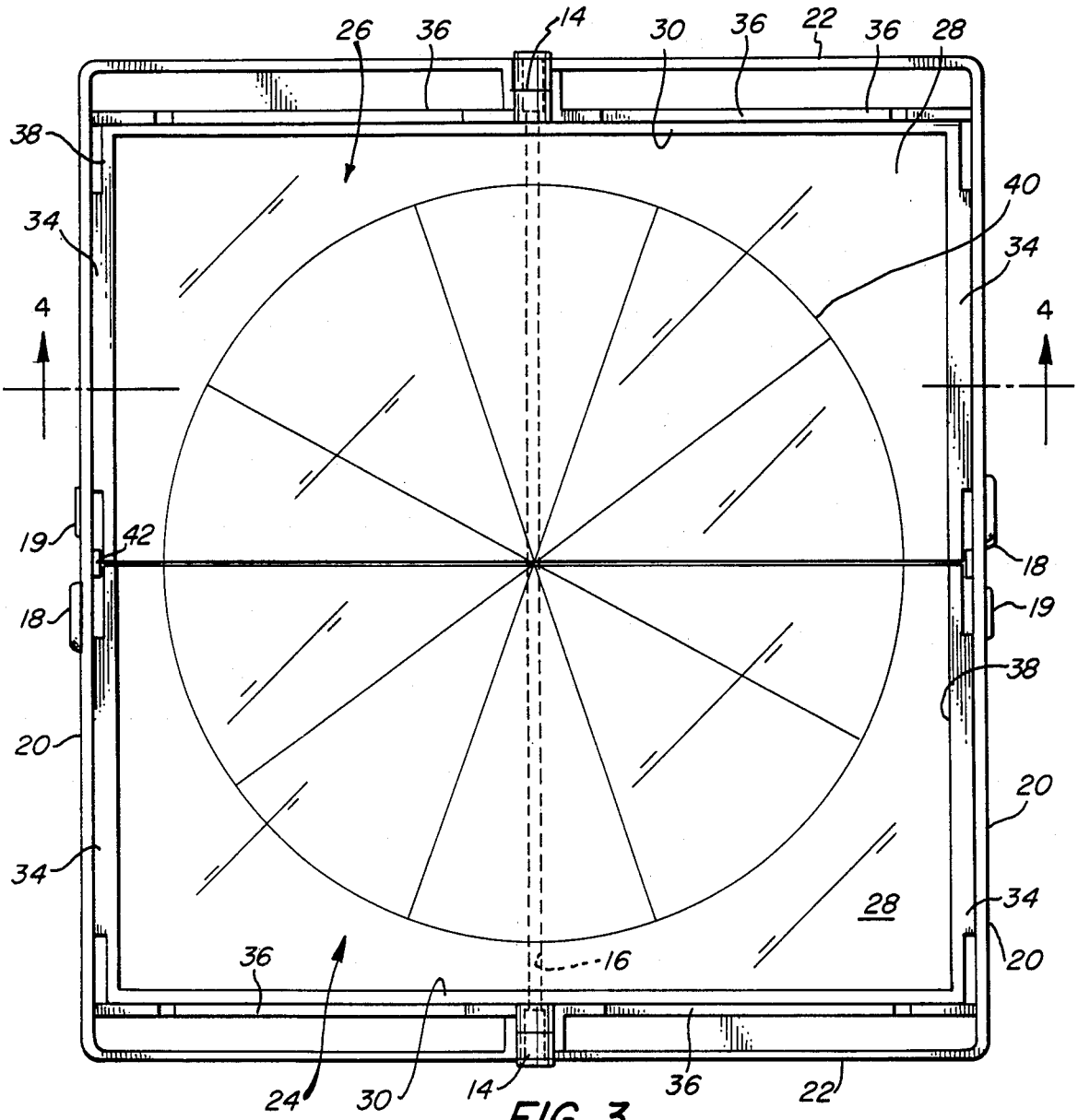
FIG. 3 is a plan view of the assembly drawn to a slightly enlarged scale with the playing board elements moved into their operative positions to rigidify the assembly.
Figure 4:
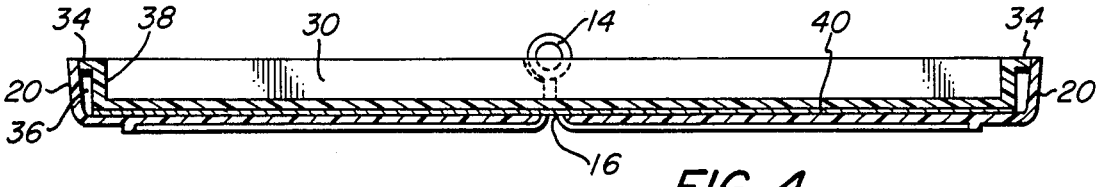
FIG. 4 is a sectional view along the line 4—4 of FIG. 3.

A portable game board assembly of the present invention includes a case comprised of the tray elements generally designated by the numerals 10 and 12 and which are elongated and hingedly connected along one of the elongated margins by the hinge members 14. Each tray element 10,12 includes a planar wall element 15, end walls 22 and an elongate side wall 20 along the side opposite the hinges 14. As best seen in FIGS. 3 and 4, the tray elements 10 and 12 do not have a side wall extending along the hinged margin 16 between the hinge elements 14. Spaced inwardly from the end walls 22 and parallel thereto are partition walls 36 which are best seen in FIG. 2.

Seated in each one of the tray elements 10 and 12 is an elongated game board element respectively generally designated by the numerals 24 and 26. Each of the game board elements 24,26 has a planar base wall 28, a side wall 30 extending along one elongate margin thereof, and end walls 38 with flanges 34 which seat over and interlock with the partition walls 36 of the tray elements 10,12. As best seen in FIGS. 2 and 4, the game board elements 24,26 are open along one elongate side margin thereof. The side walls 30 are aligned in the closed position of the case and substantially close the openings in the trays, 10, 12 between the hinges 14.

The game board elements 24,26 are fabricated from transparent synthetic resin, and a playing board pattern 40 may be imprinted upon the reverse side thereof, or it may be provided as one of a series of interchangeable printed sheets which may be disposed beneath the playing board element depending upon the game to be played. The compartments provided between the partition walls 36 and end walls 22 afford a storage area for playing pieces (not shown) to be used in connection with the games to be played with the assembly.

To secure the game board elements 24 and 26 within their respective tray elements 10 and 12, the side walls 20 have a lip 42 formed on the inner surface thereof under which the game board elements 24, 26 are wedged when they are being placed within the tray elements for storage.

On the outer surface of the side wall 20 of each tray element 10,12 are formed a resiliently deflectable latch 18 which projects beyond the margin thereof, and a cooperating clasp or keeper 19. Thus, the tray elements 10, 12 are mirror images of each other and latching is effected by a pair of cooperating elements 18 and 19.

When it is desired to utilize the assembly for game play, the elements 18 and 19 are unlatched, and the tray elements 10,12 are pivoted into the position seen in FIG. 2 in which they extend horizontally. The game board elements 24 and 26 are removed from their storage position and are rotated 90° into the positions seen in FIGS. 3 and 4 wherein their elongated axes extend across the hinge margin 16 and their side walls 30 extend along the partition walls 36. They are frictionally engaged in this position by resilient bearing pressure between the flanges 34 and the side walls 20 of the tray elements 10 and 12. As seen in FIGS. 2–4, the playing board surface defined by the playing board sheet or element 40 is visible through the transparent base wall 28 of the game board elements 24 and 26.

It will be readily appreciated that the several elements of the assembly may be fabricated from synthetic resin including the playing board sheet 40 if so desired. Although various resins may be employed, transparent polystyrene and acrylic resins are preferred for the game board elements. The tray elements and the game board elements are preferably fabricated by injection molding although thermoforming and compression molding may also be utilized.

Thus, it can be seen that the game board assembly of the present invention is one which may be readily and economically fabricated to provide a simple but highly effective portable game board assembly. Moreover, multiple game board surfaces may be provided by including within the assembly a series of interchangeable sheets defining the desired playing board surfaces. When it is desired to utilize the assembly, the game board elements may be readily removed from their storage positions and rotated into a position in which they rigidify the horizontally disposed halves of the carrying container so as to provide a relatively sturdy and effective playing board surface.

Having thus described the invention, what is claimed is:

1. A portable game assembly comprising:

(a) a foldable container comprised of a pair of tray elements, hinge means along one side margin of said tray elements joining said tray elements for movement from a closed, overlying position to an open position wherein said tray elements lie in a common plane, and latch means for securing said tray elements in said closed position, said tray elements providing recesses therewithin; and (b) a pair of elongated game board elements removably seated within respective recesses of said tray elements, said game board elements being removable from said recesses in said open position and rotatable 90° into a second position in which they seat on both tray elements and bridge the hinge line defined by said one side margin of the tray elements and seat in the recesses of both trays to rigidify said container in said open position.

2. The portable game assembly of claim 1 wherein said tray elements have a side wall opposite said one side margin and end walls, said hinge means being disposed adjacent the junction of said end walls with said one side margin and said tray elements being substantially open along said one side margin between said hinge means.

3. The portable game assembly of claim 2 wherein each of said game board elements has an upstanding side wall extending along said one side margin of their respective tray elements to effect substantial closure of the opening between the hinge means in the tray element in which seated when the container is in the closed position.

4. The portable game assembly of claim 3, wherein said game board elements also have upstanding end walls to provide side walls along three sides thereof, said game board elements being disposed with their open side margins abutting each other in said second position thereof.

5. The portable game assembly of claim 1 wherein said latch means is provided along the side margin of said tray elements opposite said one side margin.

6. The portable game assembly of claim 1 wherein said tray elements and said game board elements interfit in the storage position of said game board elements.

7. The portable game assembly of claim 6 wherein said game board elements snugly seat within said tray elements in said second position thereof.

8. The portable game assembly of claim 1 wherein said game board elements are substantially transparent and wherein said assembly includes sheet-like playing surface defining elements below said game board elements in said second position which are visible therethrough to define the game board design.

9. A portable game assembly comprising:

(a) a foldable container comprised of a pair of tray elements, hinge means along one side margin of said tray elements joining said tray elements for movement from a closed, overlying position to an open position wherein said tray elements lie in a common plane, and latch means for securing said tray elements in said closed position, said tray elements having a side wall opposite said one side margin and end walls, said hinge means being disposed adjacent the junction of said end walls with said one side margin and said tray elements being substantially open along said one side margin between said hinge means, said tray elements providing recesses therewithin; and (b) a pair of elongated game board elements removably seated within respective recesses of said tray elements, each of said game board elements having an upstanding side wall extending along said one side margin of their respective tray elements to effect substantial closure of the opening between the hinge means in the tray element in which seated in the closed position of said container, said game board elements being removable from said recesses in said open position and rotatable 90° into a second position in which they seat on both tray elements and bridge the hinge line defined by said one side margin of the tray elements and seat in the recesses of both trays to rigidify said container in said open position, said game board elements also having upstanding end walls to provide side wall along three sides thereof, said game board elements being disposed with their open side margins abutting each other in said second position thereof.

10. The portable game assembly of claim 9 wherein said tray elements and said game board elements interfit in the storage position of said game board elements.

11. The portable game assembly of claim 9 wherein said game board elements snugly seat within said tray elements in said second position thereof.

12. A portable game assembly comprising:

(a) a foldable container comprised of a pair of tray elements, hinge means along one side margin of said tray elements joining said tray elements for movement from a closed, overlying position to an open position wherein said tray elements lie in a common plane, and latch means for securing said tray elements in said closed position, said tray elements providing recesses therewithin;

(b) a pair of elongated transparent game board elements removably seated within respective recesses of said tray elements, said game board elements being removable from said recesses in said open position and rotatable 90° into a second position in which they seat on both tray elements and bridge the hinge line defined by said one side margin of the tray elements and seat in the recesses of both trays to rigidify said container in said open position, said tray element and said game board elements interfitting in the storage position of said game board elements, said game board elements snugly seating within said tray elements in said second position thereof; and (c) sheet-like playing surface defining elements below said game board elements in said second position, said surface defining elements being visible therethrough to define the game board design.

* * * * *